US008829822B2

(12) United States Patent
Laski et al.

(10) Patent No.: US 8,829,822 B2
(45) Date of Patent: Sep. 9, 2014

(54) LED-BASED LIGHT SOURCE HAVING DECORATIVE AND ILLUMINATION FUNCTIONS

(75) Inventors: Joseph Laski, Stoneham, MA (US); Makarand Chipalkatti, Lexington, MA (US); Maria Thompson, Cambridge, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 700 days.

(21) Appl. No.: 12/877,972

(22) Filed: Sep. 8, 2010

(65) Prior Publication Data

US 2012/0056556 A1 Mar. 8, 2012

(51) Int. Cl.
*H05B 37/00* (2006.01)

(52) U.S. Cl.
USPC ..... 315/316; 315/185 S; 315/291; 315/224; 315/312

(58) Field of Classification Search
USPC ..... 315/247, 185 S, 291, 307–325
See application file for complete search history.

(56) References Cited

U.S. PATENT DOCUMENTS

| | | | | |
|---|---|---|---|---|
| 7,572,028 | B2 * | 8/2009 | Mueller et al. | 362/227 |
| 7,766,489 | B2 | 8/2010 | Duine et al. | |
| 8,125,137 | B2 * | 2/2012 | Medendorp et al. | 313/501 |
| 2007/0138979 | A1 | 6/2007 | Yamada et al. | |
| 2007/0221938 | A1 | 9/2007 | Radkov et al. | |
| 2007/0223219 | A1 | 9/2007 | Medendorp, Jr. et al. | |
| 2007/0258240 | A1 * | 11/2007 | Ducharme et al. | 362/231 |
| 2010/0289727 | A1 * | 11/2010 | Miller et al. | 345/76 |
| 2012/0062133 | A1 * | 3/2012 | Cubias | 315/201 |

* cited by examiner

*Primary Examiner* — Tuyet Thi Vo
(74) *Attorney, Agent, or Firm* — Robert F. Clark

(57) ABSTRACT

A light source that generally includes multiple light emitting diode (LED) sources emitting light at different colors. A controller energizes the LED sources for establishing a changing pattern of the light colors to provide a decorative effect while simultaneously establishing white light illumination of a target area.

21 Claims, 3 Drawing Sheets

LED-BASED LIGHT SOURCE HAVING DECORATIVE AND ILLUMINATION FUNCTIONS

TECHNICAL FIELD

The present application relates to light emitting diode (LED) light sources and, more particularly, to an LED-based light source having decorative and illumination functions.

BACKGROUND

Known LED-based light sources have been implemented to provide either colorful decorative lighting or a constant white light illumination. In a decorative application, such sources may include several LEDs providing light output in different colors, for example, red, green, or blue, depending on the material composition of the LED. It is also known to construct an assembly that produces a color different from the output color of the LED, by converting the LED light output having a peak wavelength (the "primary light") to light having a different peak wavelength (the "secondary light") using luminescence/fluorescence.

The luminescent/fluorescence process involves absorbing the primary light by a wavelength-converting material such as a phosphor or mixture of phosphors thereby exciting the phosphor material, which emits the secondary light. The peak wavelength of the secondary light depends on the type of phosphor material, which can be chosen to provide secondary light having a particular peak wavelength. This process is may be generally referred to as "wavelength conversion" and an LED combined with a wavelength-converting material, such as phosphor, to produce secondary light, may be described as a "wavelength-converted LED." The term "LED source" as used herein refers to both a wavelength-converted LED and an LED that emits light at an associated peak wavelength/color.

Known decorative light sources may incorporate multiple LED sources emitting differently colored light outputs. By selection and positioning of the LEDs a decorative light source providing a multi-color light output may be produced. Such decorative light sources have been used in areas where general illumination from the light source is not required.

For general illumination, it is known to provide a separate LED light source providing a "white" light output. Such light sources may incorporate multiple LED sources emitting light of different colors that combine to produce light that appears white to an observer. It is often desirable to produce white light having a relatively high color rendering index (CRI). The color rendering index of a light source is an objective measure of the ability of the light generated by the source to accurately illuminate a broad range of colors. The color rendering index ranges from essentially zero for monochromatic sources to 100 for incandescent sources.

In addition, the chromaticity of a particular light source may be referred to as the "color point" of the source. For a white light source, the chromaticity may be referred to as the "white point" of the source. The white point of a white light source may fall along a locus of chromaticity points corresponding to the color of light emitted by a black-body radiator heated to a given temperature expressed in Kelvin (K). Accordingly, a white point may be identified by a correlated color temperature (CCT) of the light source, which is the temperature at which the heated black-body radiator matches the color or hue of the white light source. White light typically has a CCT of between about 2600 and 8000 K. White light with a CCT of 4000 has a yellowish color. White light with a CCT of 8000 K is more bluish in color, and may be referred to as "cool white." "Warm white" may be used to describe white light with a CCT of between about 2600 K and 4000 K, which is more reddish in color.

BRIEF DESCRIPTION OF THE DRAWINGS

Reference should be made to the following detailed description which should be read in conjunction with the following figures, wherein like numerals represent like parts.

DETAILED DESCRIPTION

A light source consistent with the present disclosure generally includes multiple light emitting diode (LED) sources configured to emit light at different colors. A controller is configured to energize the LED sources for establishing a changing pattern of the light colors, e.g. in a mosaic pattern, that is visible to an observer to provide a decorative effect. The changing pattern of colors is provided by changing patterns of light outputs from the LED sources that combine at a distance from the light source to establish a white light illumination of a target area.

Figure 1:
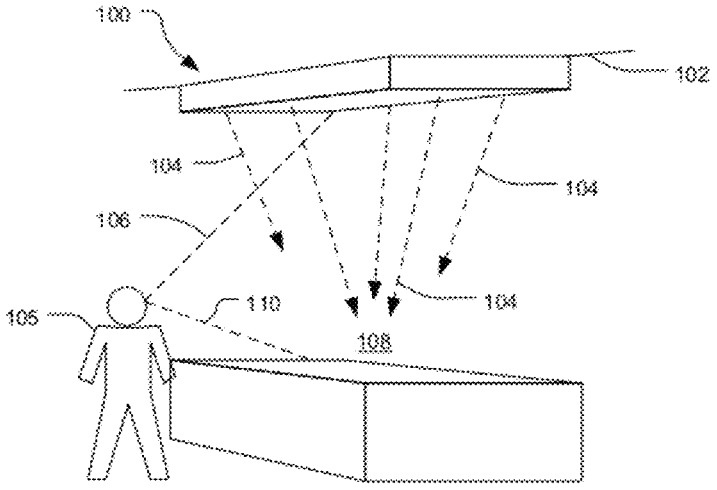
FIG. 1 diagrammatically illustrates one embodiment of a light source consistent with the present disclosure and operation thereof.

FIG. 1 diagrammatically illustrates a light source 100 consistent with the present disclosure and operation thereof. In the illustrated exemplary embodiment, the light source 100 is mounted to a ceiling 102. The light source 100 may however be mounted to any structure where it is desired to provide both a decorative effect and general illumination.

As shown, the light source 100 may be configured to emit light, as indicated by arrows 104, from multiple LED sources in a changing pattern to produce a changing multi-color output visible by an observer 105 looking the exterior surface of the light source, as indicated by arrow 106. The changing pattern may be achieved by selectively dimming or energizing one or more groups of the LED sources and energizing one or more other groups of the LED sources according to a predetermined or random time sequence.

At same time the light source 100 is generating a changing multi-color output visible at the exterior surface of the source, the light outputs emitted by the LEDs combine at a distance from the light source 100 to produce white light illumination of a target area 108 that is perceptible by an observer as indicated by arrow 110. The distance at which the light outputs of the LED sources combine to produce white light illumination may vary depending upon the number and arrangement of the LED sources and the dimensions and geometry of the light source 100, and can be adjusted depending on the application. In one embodiment including a light source 100 configured as a flat panel to be installed on a ceiling 102, for example, the light outputs of the LED sources may combine to provide white light illumination at a distance of about 2 feet from the light source.

The term "white light" as used herein refers to any combination of two or more LED source light outputs that exhibits a CCT in the range from 2600-8000K. In general, the white light illumination established by the combined light outputs of the LED sources may exhibit steady quality parameters, e.g. within a desired range. For example, the white light illumination provided by a light source consistent with the present disclosure may exhibit CCT, CRI, Commission International de l'Eclairage (CIE) x, y coordinates and/or luminous output within a desired range so that as the LED sources are selectively dimmed and energized combinations of the energized LEDs produce a relatively steady CCT, CRI, CIE x, y coordinates and/or luminous output.

Figure 2:
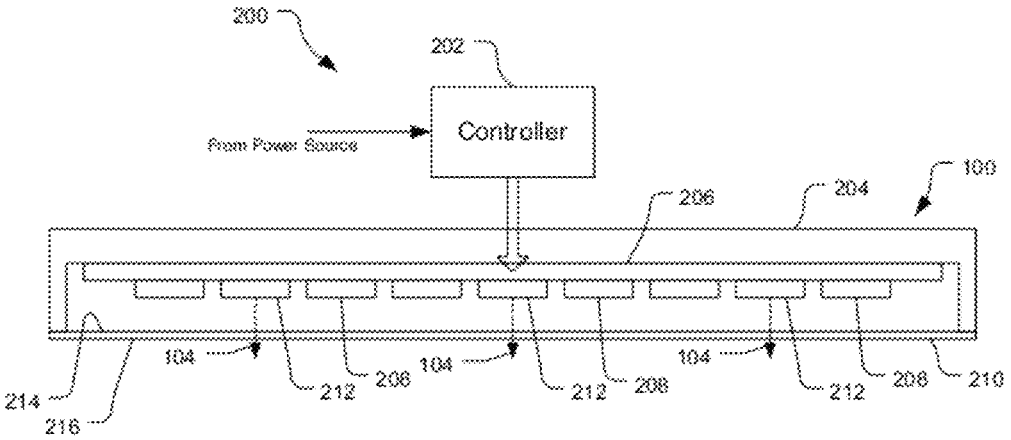
FIG. 2 illustrates one embodiment of a light source system consistent with the present disclosure showing a light source consistent with the present disclosure in cross-section.

For example, in one embodiment the CCT, CRI, CIE x and y coordinates and/or luminous output of the white light illumination established by different energized combinations of the LED sources may vary only within a desired tolerance, e.g. by about ±10%, as different LED sources, or groups of LED sources, are selectively dimmed and energized to establish a changing multi-color output at the surface of the light source. Such a steady white light illumination may be achieved by maintaining a specific lumens-per-color ratio (e.g. within a range) in the output light from the LED sources as the sources are selectively dimmed and energized. As used herein, the term "lumens-per-color ratio" refers to a ratio of the number of lumens delivered at each of a plurality of colors by a plurality of differently colored LED sources. The specific lumens-per-color ratio may be selected to result in a white light illumination having desired CCT, CRI, CIE x,y coordinates and/or luminous output values or ranges when the outputs of the LEDs establishing the lumens-per-color ratio are combined on a target illumination surface Turning now to FIG. 2, there is illustrated one embodiment of a light source system 200 consistent with the present disclosure including a light source 100 consistent with the present disclosure illustrated in cross-section. The illustrated light source system includes a controller 202 and the light source 100. The light source 100 includes a housing 204, a substrate 206, LED sources 208 disposed on the substrate 206 and a diffuser 210. As shown, a plurality of LED sources 208 of different colors may be mounted on the substrate 206, e.g. a printed circuit board, for connection to the controller 202 for selectively for energizing the LED sources 208 in response to an input to the controller 202 from a power source. The substrate 206 and the LED sources 208 may be enclosed in the housing 204 by the diffuser 210, which is coupled to the housing 204.

Light emitting surfaces 212 of the LED sources 208 may be in opposed facing relationship to the interior surface 214 of the diffuser 210. Light emitted by the LED sources 208 passes through the diffuser 210 and is visible by an observer at the exterior surface 216 of the diffuser 210. The diffuser 210 may take any known diffuser configuration and may diffuse the multi-colored light output from the LED sources 208 so that a decorative appearance is provided at the exterior surface 216 of the diffuser 210.

The distance from the LED sources to the interior surface 214 of the diffuser 210 may be selected to provide a desired appearance at the exterior surface 216 to an observer. The distance may be selected to soften the glare of the outputs of the LED sources 208 and/or to enable color blending of neighboring LED sources 208. If, for example, the diffuser 210 is relatively close to the LED sources 208, a pair of red and yellow LED sources that are close to each other may manifest as two discrete color patches on the exterior surface of the diffuser. However, if the diffuser 210 is relatively distant from the LED sources red and yellow LED sources that are close to each other may blend to manifest a single orange patch, thus producing a new color not provided as an output of any of the discrete LED sources 208. White LED sources may also be blended with colored LED sources to produce pastel colors through selectively positioning the diffuser 210 relative to the LED sources 208.

Figure 3:
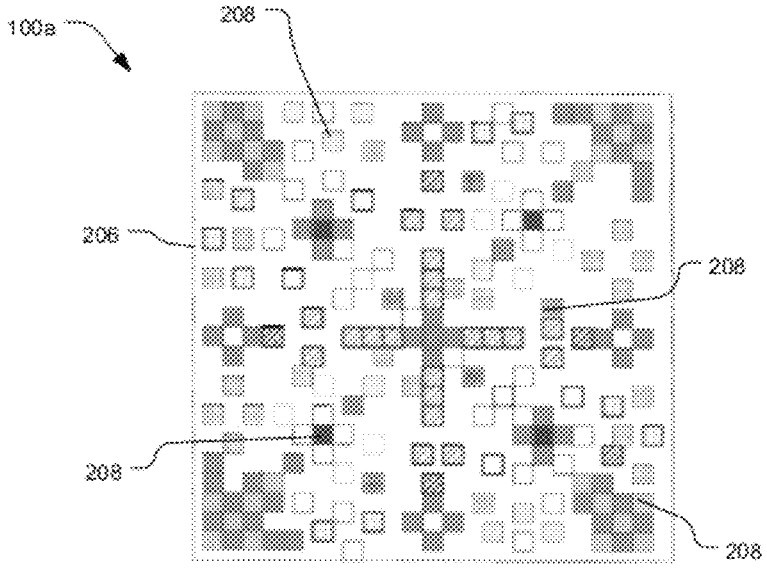
FIG. 3 diagrammatically illustrates one embodiment of a light source consistent with the present disclosure.

FIG. 3 illustrates one embodiment of a light source 100*a* consistent with the present disclosure. As shown, differently colored LEDs sources 208 may be positioned in a pattern on a substrate 206 selected to produce a decorative effect. As used herein the term "colored" when used to describe an LED source 208 or the light output therefrom refers to a range of peak wavelengths associated with the light emitted by the LED source. Differently colored LED sources thus emit light having a peak wavelength in different wavelength ranges associated with different colors. Use of a specific color such as "red", "green", "blue", "orange", "yellow", etc. to describe an LED source or the light emitted by the LED source refers to a specific range of peak wavelengths associated with the specific color. In particular, the term "blue" when used to describe an LED source or the light emitted by the LED source means the LED emits light with a peak wavelength between 420 nm and 490 nm. The term "green" when used to describe an LED source or the light emitted by the LED source means the LED emits light with a peak wavelength between 495 nm and 570 nm. The term "red" when used to describe an LED source or the light emitted by the LED source means the LED emits light with a peak wavelength between 610 nm and 630 nm. The term "yellow" when used to describe an LED source or the light emitted by the LED source means the LED emits light with a peak wavelength between 570 nm and 590 nm. The term "orange" when used to describe an LED source or the light emitted by the LED source means the LED emits light with a peak wavelength between 590 nm and 620 nm.

The LED sources 208 may be arranged in groups with each group configured to provide a specific lumen-per color ratio that is nominally the same as the lumens-per-color ratio of the other groups. The groups of LED sources 208 may be electrically grouped, i.e. they may be energized by the same power source so that they are emitting light at the same time, and are not necessarily, although possibly, spatially grouped. In the embodiment illustrated in FIG. 3 the LEDs sources 208 within each group of LED sources 208 are not positioned adjacent to each other on the substrate 206 but instead are spread about the surface of the substrate 206 so that when selected groups are dimmed the energized groups of LED sources 208 emit light from various regions of the substrate 206. The spatial arrangement of each group and/or the LEDs within each group may thus be selected based on a desired decorative design associated with the light source, e.g. in a mosaic pattern. In addition, or alternatively the spatial arrangement of each group and/or the LEDs within each group may be selected to present an informational or marketing message.

With the LED sources 208 arranged in groups configured to provide nominally the same lumens-per-color ratio, one or more of the groups of LED sources 208 may be selectively dimmed, e.g. according to a predetermined or random sequence, to establish a changing multi-color output, but the lumens-per-color ratio remains relatively steady since each group that remains energized establishes nominally the same lumens-per-color ratio. As used herein, use of the term "nominal" or "nominally" when referring to an amount means a designated or theoretical amount that may vary from the actual amount. The lumens-per-color ratio in such an embodiment would not be affected by the specific locations of the energized LED sources 208 or the rate change in the dimming of the LED sources. Although embodiments are described herein in connection with the lumens-per-color ratio of various separate groups of LED sources being nominally the same, variations in the lumens-per-color ratio between the groups are possible as long as the combined light outputs of the energized LED sources produces a white light illumination. In one embodiment, for example, the lumens-per-color ratio(s) of the separate groups of LED sources may be selected to achieve a white light illumination of a target area having a desired or selected CCT, CRI, and/or CIE x and y coordinates within a range of ±10% during the changing multi-color output established by the LED sources.

Any known LED source, including a specific color LEDs, wavelength-converted LEDs or combinations thereof, may be used as an LED source 208 in a light source consistent with the present disclosure. In a specific example, the LED sources 208 may be BACKLIGHT™ LED modules commercially available from Osram Sylvania of Danvers, Mass. Multiple groups of such LED sources including red, yellow, green and blue sources may be combined to exhibit a lumens-per-color ratio of 12 green, 3 blue, 6 yellow, 1 orange, 1 red and 4 white to establish a white light illumination in the target area with CCT of approximately 3400, a CRI of approximately 86 and a total lumen output of 530 lumens. As the groups are selectively dimmed, the groups that remain energized maintain the same the specific nominal lumens-per-color ratio to establish a steady white light illumination at a distance from the light source.

Figure 4:
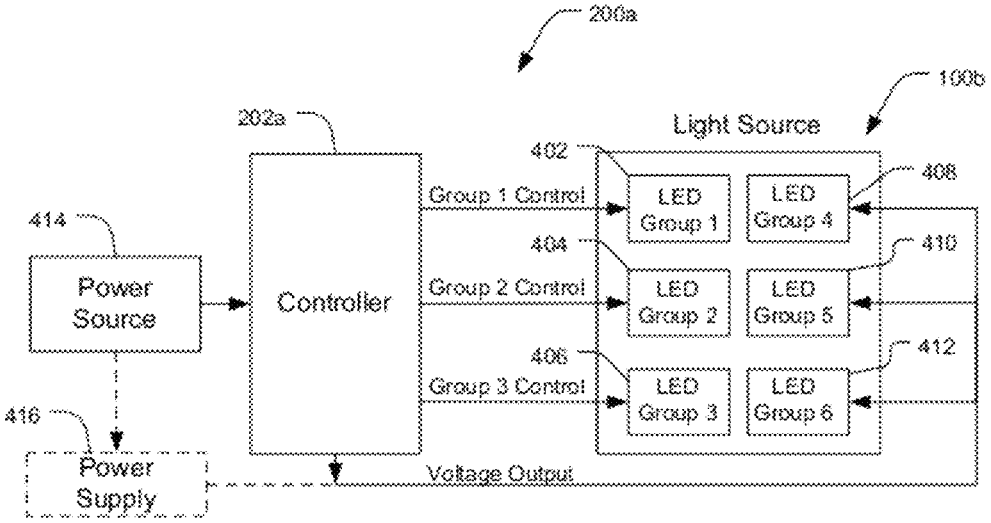
FIG. 4 is a block diagram illustrating a light source system consistent with the present disclosure.

FIG. 4 illustrates one embodiment of a light source system 200*a* consistent with the present disclosure including a light source 100*b* with groups 402, 404, 406, 408, 410, 412 of LED sources 208 arranged on a substrate 206 and configured to be selectively dimmed and energized by a controller 202*a*. The illustrated exemplary embodiment includes six groups 402, 404, 406, 408, 410, 412 of LED sources 208 having nominally the same lumens-per-color ratio. The controller 202*a* may receive a power input from a power source 414, e.g. AC line voltage at 120 v, and provide separate control signals GROUP 1 CONTROL, GROUP 2 CONTROL, GROUP 3 CONTROL to three 402, 404, 406 of the groups of LED sources 208 for dimming and energizing the LEDs within the groups 402, 404, 406 according to a predetermined or random time sequence. The other three groups 408, 410, 412 may be coupled to a constant VOLTAGE OUTPUT so that the LED sources within the groups 408, 410, 412 are constantly energized. The constant VOLTAGE OUTPUT may be provided by the controller 202A, as shown. Alternatively, the constant VOLTAGE OUTPUT may be provided by a power supply 416 that receives input from the power source 414 and provides the VOLTAGE OUTPUT output to the groups 408, 410, 412.

The term "coupled" as used herein refers to any connection, coupling, link or the like by which signals carried by one system element are imparted to the "coupled" element. Such "coupled" devices, or signals and devices, are not necessarily directly connected to one another and may be separated by intermediate components or devices that may manipulate or modify such signals. Likewise, the terms "connected" or "coupled" as used herein in regard to physical connections or couplings is a relative term and does not require a direct physical connection.

The controller 202*a* may include an application specific integrated circuit (ASIC) or a programmable processor configured to provide control signals to the groups 402, 404, 406, 408, 410, 412 of LED sources 208, e.g. pursuant to programmed instructions stored in a tangible computer readable medium. The controller 202*a* may be co-located with the light source 100*b*, e.g. within the housing, or may be remote therefrom, e.g. in separate room. Also, the control signals may be coupled to the light source using hard wire connections or using known wireless techniques.

In one embodiment, the controller 202*a* may be a digital controller, such as an OPTOTRONIC® OT RGB™ Sequencer commercially available from Osram Sylvania of Danvers, Mass., which is a three-channel, pulse-width modulated (PWM) sequencer. In such an embodiment, the controller 202*a* may generate PWM control signals at its R-, G- and B-outputs that are provided as the GROUP 1 CONTROL, GROUP 2 CONTROL, GROUP 3 CONTROL control signals. The R-, G- and B-outputs are provided according to a preset sequence characteristic and modulated to an applied input voltage of 10-24V. The speed/timing of the sequence can be controlled by applying an input to the 1-10V control input of the controller.

In the illustrated embodiment, the half 408, 410, 412 of the LED source groups, each having the same nominal lumens-per-color ratio, remain energized (i.e. with no dimming) by the constant VOLTAGE OUTPUT during operation. Thus, half of the color pattern in the illustrated embodiment is fixed and continuously operated at full power to display a fixed color pattern. The other half 402, 404 406 of the LED source group have the same nominal lumens-per-color ratio as the groups 408, 410, 412 and are controlled by the control signals GROUP 1 CONTROL, GROUP 2 CONTROL, GROUP 3 CONTROL from the controller 202*a* to dim the LED source groups 408, 410, 412 in a time sequence to generate a changing/moving color pattern visible by an observer. The controller 202*a* may cause each LED source group 408, 410, 412 to slowly or quickly dim, e.g. one or more of groups at a time, in a pre-defined or random time intervals while maintaining the light output and nominal lumens-per-color ratio necessary to provide white light illumination of a target area.

Although the illustrated exemplary embodiment includes half of the LED source groups energized to provide a constant output during operation and the other half configured to be dimmed by the controller, any combination of dimmed and energized groups may be implemented. In one embodiment, all of the LED source groups 402, 404, 406, 408, 410, 412 may be controlled for dimming by the controller 202*a*. In such a configuration, some minimal number of groups maintaining a nominal lumens-per-color ratio in common with the other groups may be energized at all times to provide the white light illumination of the target area.

Figure 5:
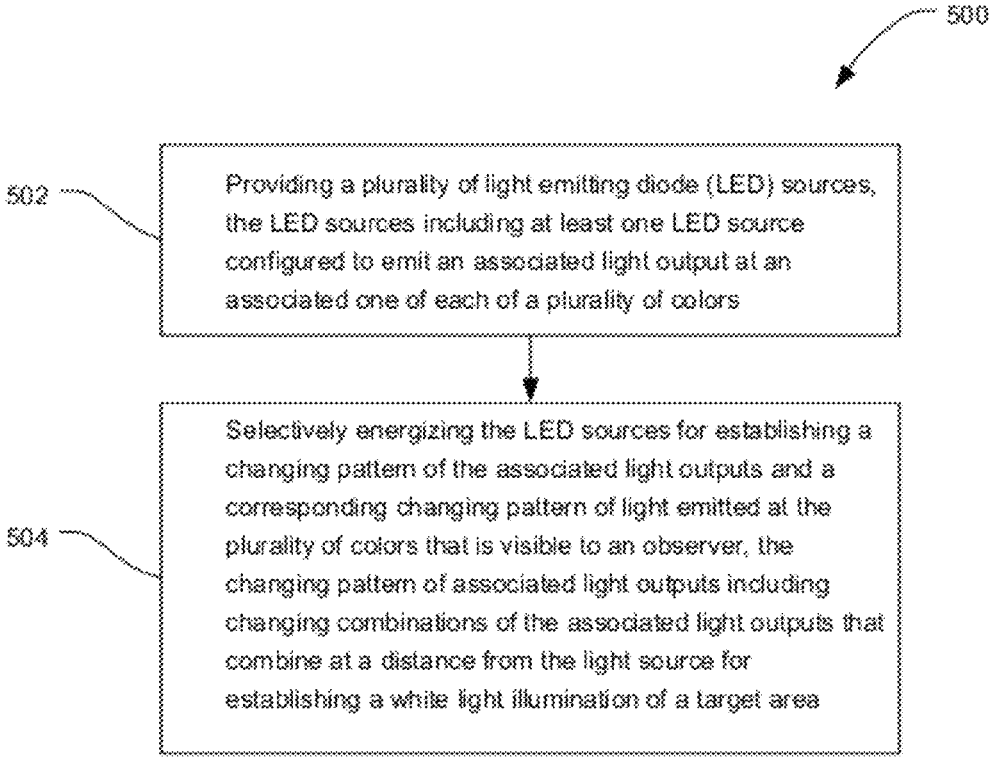
FIG. 5 is a block flow diagram illustrating operations according to one method consistent with the present disclosure.

FIG. 5 is a block flow diagram of exemplary operations according to one embodiment of a method consistent with the present disclosure. It is to be understood that other embodiments of the present disclosure may include sub-combinations of the operations depicted in FIG. 5 and/or additional operations described herein. Thus, claims presented herein may be directed to all or part of the components and/or operations depicted in one or more figures. In addition, there is no requirement that the operations depicted in FIG. 5, or described elsewhere herein, occur in the order presented, unless stated otherwise.

As shown, a method 500 consistent with the present disclosure includes providing 502 a plurality of light emitting diode (LED) sources. The LED sources include at least one LED source configured to emit an associated light output at an associated one of each of a plurality of colors. The LED sources are selectively energizing 504 for establishing a changing pattern of the associated light outputs and a corresponding changing pattern of light emitted at the plurality of colors that is visible to an observer. The changing pattern of associated light outputs includes changing combinations of the associated light outputs that mix at a distance from the light source for establishing a white light illumination of a target area.

Embodiments of the methods described herein may be implemented using a processor and/or other programmable device. To that end, the methods described herein may be implemented on a tangible computer readable medium having instructions stored thereon that when executed by one or more processors perform the methods. Thus, for example, controller may include a storage medium (not shown) to store instructions (in, for example, firmware or software) to perform the operations described herein. The storage medium may include any type of tangible medium, for example, any type of disk including floppy disks, optical disks, compact disk read-only memories (CD-ROMs), compact disk rewritables (CD-RWs), and magneto-optical disks, semiconductor devices such as read-only memories (ROMs), random access memories (RAMs) such as dynamic and static RAMs, erasable programmable read-only memories (EPROMs), electrically erasable programmable read-only memories (EEPROMs), flash memories, magnetic or optical cards, or any type of media suitable for storing electronic instructions.

There is thus provided a light source that generally includes multiple light emitting diode (LED) sources emitting light at different colors. A controller energizes the LED sources for establishing a changing pattern of the light colors, e.g. in a mosaic pattern, that is visible to an observer to provide a decorative effect. The changing pattern of colors is established by changing patterns of light outputs from the LED sources that combine at a distance from the light source to establish a white light illumination of a target area. The outputs of the LED source and the white light illumination may have a modulated appearance to match environmental conditions. A light source consistent with the present disclosure may be useful in establishing colorful dynamic effects visible upon observation of the light source while simultaneously maintaining a substantially constant level of white light illumination of a target area. The LED sources may be positioned in the light source to provide a decorative effect and/or the LED source may be patterned to present an informational or marketing message.

According to one aspect of the disclosure, there is provided a light source system including a plurality of light emitting diode (LED) sources and a controller. The plurality of LED sources includes at least one LED source configured to emit an associated light output at an associated one of each of a plurality of colors. The controller is configured for selectively energizing the LED sources for establishing a changing pattern of the associated light outputs and a corresponding changing pattern of light emitted at the plurality of colors that is visible to an observer. The changing pattern of associated light outputs includes changing combinations of the associated light outputs configured to combine at a distance from the light source for establishing a white light illumination of a target area.

According to another aspect of the disclosure, there is provided a light source including a plurality of light emitting diode (LED) sources including at least one LED source configured to emit an associated light output at an associated one of each of a plurality of colors. The LED sources are configured in separate groups. Each of the separate groups includes associated ones of the plurality of LED sources coupled for being energized or dimmed at the same time for establishing a changing pattern of the associated light outputs and a corresponding changing pattern of light emitted at the plurality of colors that is visible to an observer. The changing pattern of associated light outputs includes changing combinations of the associated light outputs configured to combine at a distance from the light source for establishing a white light illumination of a target area.

According to another aspect of the disclosure, a method of providing simultaneous decorative and white light illumination. The method includes providing a plurality of light emitting diode (LED) sources, the plurality of LED sources including at least one LED source configured to emit an associated light output at an associated one of each of a plurality of colors; and selectively energizing the LED sources for establishing a changing pattern of the associated light outputs and a corresponding changing pattern of light emitted at the plurality of colors that is visible to an observer, the changing pattern of associated light outputs including changing combinations of the associated light outputs that combine at a distance from the light source for establishing a white light illumination of a target area.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A light source system comprising:

a plurality of light emitting diode (LED) sources, said plurality of LED sources comprising at least one LED source configured to emit an associated light output at an associated one of each of a plurality of colors; and a controller configured for selectively energizing said LED sources for establishing a changing pattern of said associated light outputs and a corresponding changing pattern of light emitted at said plurality of colors that is visible to an observer, said changing pattern of associated light outputs comprising changing combinations of said associated light outputs configured to combine at a distance from said light source for establishing a white light illumination of a target area.

2. A light source system according to claim 1, wherein said white light illumination exhibits a correlated color temperature (CCT), color rendering index (CRI) or Commission International de l'Eclairage (CIE) x,y coordinates within a range of ±10% during said changing pattern of light emitted at said plurality of colors.

3. A light source system according to claim 1, wherein said plurality of LED sources are configured to establish a predetermined nominal lumens-per-color ratio associated with said plurality of colors.

4. A light source system according to claim 1, wherein said plurality of LED sources are configured in separate groups, each of said separate groups comprising associated ones of said plurality of LED sources coupled to said controller for being energized or dimmed at the same time.

5. A light source system according to claim 4, wherein said controller is configured to provide a plurality of control outputs, each of said control outputs being configured to selectively energize an associated one of said separate groups.

6. A light source system according to claim 4, wherein each of said separate groups is configured to establish the same predetermined nominal lumens-per-color ratio associated with said plurality of colors.

7. A light source system according to claim 1, said light source further comprising a plurality of fixed output LED sources, said fixed output LED sources being configured to be constantly energized during said changing pattern of light emitted at said plurality of colors.

8. A light source system according to claim 7, wherein said plurality of fixed output LED sources comprise at least one LED source configured to emit an associated light output at an associated one of each of said plurality of colors.

9. A light source system according to claim 7, wherein said fixed output LED sources are configured to establish a predetermined nominal lumens-per-color ratio associated with said plurality of colors.

10. A light source comprising:

a plurality of light emitting diode (LED) sources, said plurality of LED sources comprising at least one LED source configured to emit an associated light output at an associated one of each of a plurality of colors, said plurality of LED sources being configured in separate groups, each of said separate groups comprising associated ones of said plurality of LED sources coupled for being energized or dimmed at the same time for establishing a changing pattern of said associated light outputs and a corresponding changing pattern of light emitted at said plurality of colors that is visible to an observer, said changing pattern of associated light outputs comprising changing combinations of said associated light outputs configured to combine at a distance from said light source for establishing a white light illumination of a target area.

11. A light source according to claim 10, wherein said white light illumination exhibits a correlated color temperature (CCT), color rendering index (CRI) or Commission International de l'Eclairage (CIE) x,y coordinates within a range of ±10% during said changing pattern of light emitted at said plurality of colors.

12. A light source according to claim 10, wherein said plurality of LED sources are configured to establish a predetermined nominal lumens-per-color ratio associated with said plurality of colors.

13. A light source according to claim 10, wherein each of said separate groups is configured to establish the same predetermined nominal lumens-per-color ratio associated with said plurality of colors.

14. A light source according to claim 10, said light source further comprising a plurality of fixed output LED sources, said fixed output LED sources configured to be constantly energized during said changing pattern of light emitted at said plurality of colors.

15. A light source according to claim 14, wherein said plurality of fixed output LED sources comprise at least one LED source configured to emit an associated light output at an associated one of each of said plurality of colors.

16. A light source according to claim 14, wherein said fixed output LED sources are configured to establish a predetermined nominal lumens-per-color ratio associated with said plurality of colors.

17. A method of providing simultaneous decorative and white light illumination, said method comprising:

providing a plurality of light emitting diode (LED) sources, said plurality of LED sources comprising at least one LED source configured to emit an associated light output at an associated one of each of a plurality of colors; and selectively energizing said LED sources for establishing a changing pattern of said associated light outputs and a corresponding changing pattern of light emitted at said plurality of colors that is visible to an observer, said changing pattern of associated light outputs comprising changing combinations of said associated light outputs that combine at a distance from said light source for establishing a white light illumination of a target area.

18. A method according to claim 17, wherein said white light illumination exhibits a correlated color temperature (CCT), color rendering index (CRI) or Commission International de l'Eclairage (CIE) x,y coordinates within a range of ±10% during said changing pattern of light emitted at said plurality of colors.

19. A method according to claim 17, wherein said plurality of LED sources are configured to establish a predetermined nominal lumens-per-color ratio associated with said plurality of colors.

20. A method according to claim 17, wherein said plurality of LED sources are configured in separate groups, each of said separate groups comprising associated ones of said plurality of LED sources configured for being energized or dimmed at the same time.

21. A light source comprising: a plurality of light emitting diode (LED) sources, said LED sources simultaneously producing a changing pattern of light that is visible to an observer and a white light illumination at a target area at a distance from said light source, said changing pattern of light comprising a plurality of colors and said white light illumination exhibiting a correlated color temperature (CCT), color rendering index (CRI) or Commission International de l'Eclairage (CIE) x,y coordinates within a range of ±10%.

* * * * *